US005252386A

United States Patent [19]

Hughes et al.

[11] Patent Number: 5,252,386

[45] Date of Patent: Oct. 12, 1993

[54] FIRE RETARDANT ENTANGLED POLYESTER NONWOVEN FABRIC

[75] Inventors: Alfred J. Hughes, Princeton, N.J.; Douglas Van Oglesby, Benson, N.C.

[73] Assignee: Chicopee, New Brunswick, N.J.

[21] Appl. No.: 850,538

[22] Filed: Mar. 13, 1992

[51] Int. Cl.[5] ..... D03D 3/00

[52] U.S. Cl. ..... 428/224; 28/104; 28/240; 428/288; 428/299; 428/910; 428/913; 428/920

[58] Field of Search ..... 428/299, 910, 913, 920, 428/300, 301, 290, 245, 224, 288; 28/104, 240

[56] References Cited

U.S. PATENT DOCUMENTS 4,883,709 11/1989 Nozaki et al. ..... 428/299

4,919,998 4/1990 Goad et al. ..... 428/920

*Primary Examiner*—James J. Bell

*Attorney, Agent, or Firm*—Lawrence D. Schuler

[57] ABSTRACT

An entangled polyester fiber nonwoven fabric with balanced tensile strength properties and with a fire retardancy in both the machine and cross machine directions of greater than 20 secs. when measured in accordance with NFPA Test No. 702.

9 Claims, 1 Drawing Sheet

FIRE RETARDANT ENTANGLED POLYESTER NONWOVEN FABRIC

BACKGROUND OF THE INVENTION

The present invention relates to an entangled nonwoven fabric of polyester fibers which has improved fire retardant properties and balanced tensile strength properties. More specifically, the invention relates to an entangled nonwoven fabric of polyester fibers which has a fire retardancy of greater than 20 seconds in both the fabric machine direction and cross machine direction when tested in accordance with the standard NFPA Test No. 702.

Entangled nonwoven fabrics have been used for a considerable period of time in many applications. They find use in protective garments used in the operating room and in protective garments used by hazardous material ("hazmat") operators, industrial workers such as paint spray operators, sand blasters and the like. Such fabrics also have found use in surgical drapes and tray covers, wipes, and the like. Many of these uses require that the fabric be fire retardant.

It has long been known to treat textile fabrics so as to reduce their combustibility. Early chemists found that ammonium salts of sulfuric, phosphoric, and hydrochloric acids were effective as fire retardants, as well as certain mixtures of these with borax. Later it was discovered that complex heavy metal ions (stannates and tungstates) improved the water resistance of fabrics treated with ammonium salts. In the 1930's, the effect of mixing antimony oxide with organic halogen compounds was discovered. These three efforts represent the major discoveries on which modern flame-retardant chemicals are based. The technology has become considerably more sophisticated in recent years, but for the most part it represents variations on these earlier themes.

Fire retardancy is often measured by the time it takes to burn a test sample of specified size, with longer combustion times being regarded as indicative of better fire retardancy. The fire retardancy of fabrics comprised of thermoplastic fibers, and more particularly nonwoven entangled polyester fabrics, is attributable in some part to a phenomenon known as "melt off". This means, particularly in a test stand, the thermoplastic fibers melt due to the heat of combustion and drop off the specimen being tested, thus impeding the advancement of the flame front. Latex binders are frequently applied to entangled polyester nonwoven fabrics to enhance dimensional stability; provide abrasion resistance; or to anchor colorants such as pigments. Even if the added latex binder is not flammable in its own right, it tends to restrict the "melt off" phenomenon. This reduces the time it takes to burn the test sample, and the sample is thus regarded, perhaps inaccurately, as having inadequate fire retardancy. Those skilled in the art are always seeking ways to provide fabrics having improved fire retardancy as indicated by increased combustion times in the aforementioned "burn test".

Entangled polyester nonwoven fabrics normally have unbalanced properties, i.e., they have more fibers aligned in one direction (machine direction) as compared to the fibers aligned in a second direction (cross machine direction) which is perpendicular to the first direction. This imbalance causes these polyester fabrics to fail the NFPA Test No. 702 fire retardancy standard even when treated with a fire retardant finish. It has now been found that entangled polyester nonwoven fabrics when treated with a fire retardant finish and cross stretched prior to and while the finish is being dried on the fabric provides a fabric which has a fire retardancy of greater than 20 seconds in both the machine direction and cross machine direction as measured in accordance with NFPA Test No. 702.

It is therefore an object of this invention to provide entangled polyester fiber fabrics of improved fire retardancy.

It is a further object of this invention to provide entangled polyester fiber fabrics which have a fire retardancy of greater than 20 seconds in both the machine direction and cross machine direction as measured by NFPA Test No. 702.

It is another object of this invention to provide fire retardant entangled nonwoven fabrics which have balanced tensile strength properties.

It is yet a further object of the present invention to provide a method of producing the entangled fabric of polyester fibers with balanced tensile strength properties and improved fire retardancy.

As used herein, the term "balanced tensile strength properties" means that the cross direction tensile strength is nearly the same as the machine direction tensile strength.

SUMMARY OF THE INVENTION

In accordance with the present invention, there is provided an entangled nonwoven fabric of polyester fibers which has balanced tensile strength properties and improved fire retardant properties. The balanced tensile strength properties and improved fire retardant properties are achieved by cross stretching the entangled fabric after the fabric has been wetted with an aqueous-based fire retardant composition and drying the wetted fabric while maintaining it in its stretched state.

The resultant entangled nonwoven fabric of polyester fibers has balanced tensile strength properties and improved fire retardant properties. The tensile strength properties are nearly equal in the machine and cross machine directions. The fire retardant properties of the fabric of the invention, when tested in accordance with NFPA Test No. 702, are greater than 20 seconds in both the machine and cross machine directions.

BRIEF DESCRIPTION OF THE DRAWINGS

The invention will be more clearly understood by reference to the following detailed description and the accompanying drawing in which.

DETAILED DESCRIPTION OF THE INVENTION

Figure 1:
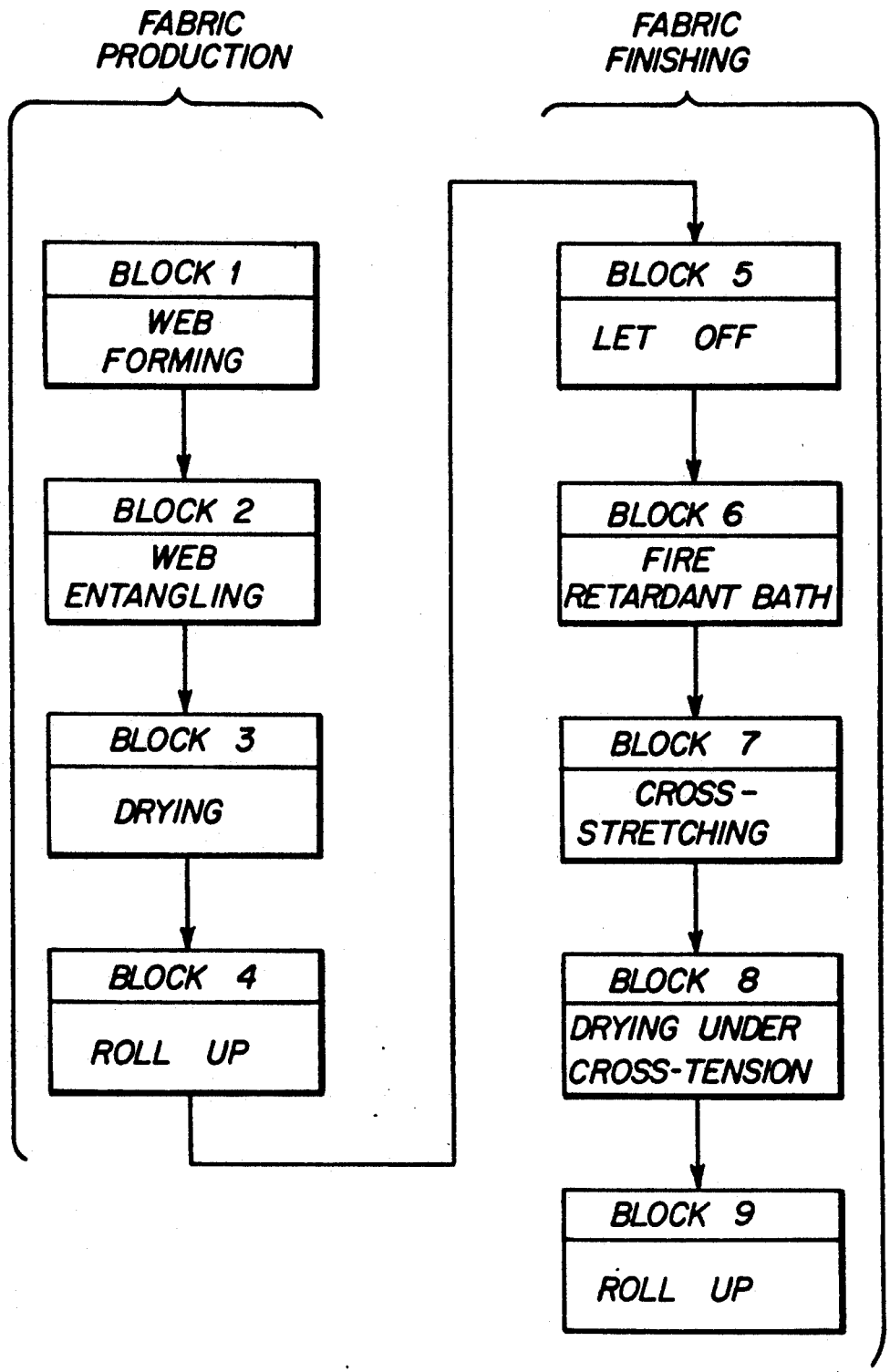
FIG. 1 is a block diagram of the process used to produce the entangled nonwoven fabric of the present invention.

Referring now to the accompanying drawing, the block diagram of FIG. 1 shows the process of preparing the fabric of the invention. Blocks 1–4 shows the process of producing a base entangled fabric. Blocks 5–9 shows the process for finishing the base fabric so as to impart balanced tensile strength and fire retardant properties.

As shown in Block 1, the production of the base fabric begins with the preparation of a fibrous web of individualized fibers. The web comprises 100% polyester fibers. The web may be formed by air laying, carding or other methods well known to those skilled in the art. The starting web may be a combination of air laid and carded webs or a combination of webs prepared by other methods.

The web of fibers may weigh between 0.3 osy and 4 osy or even more. It is preferred that the web weigh between 1 osy and 2 osy. The polyester fibers are staple length fibers.

The formed fibrous web is entangled using an apparatus and process such as those disclosed in Evans U.S. Pat. No. 3,485,706, the teachings of which are herein incorporated by reference. The number of orifice manifolds employed in the process and the water pressure used in each manifold will be evident to those skilled in the art. Pressures of up to 1,200 psig or even more may be used. It is preferred to produce a well entangled strong fabric. To achieve the preferred strength requires an entangling energy input of at least 0.5 hp-hr/lb. The preferred entangling energy input is 0.7 hp-hr/lb. or greater.

After the entangling step (Block 2) the now entangled web is dried (Block 3) to form the base fabric which is then batched or rolled up (Block 4). Drying may be achieved by conventional steam heated cans, convection oven, or other means well known to those skilled in the art.

The rolled up base fabric is now ready for finishing. The finishing process begins with let off (Block 5) of the entangled polyester nonwoven base fabric. An aqueous fire retardant composition comprising an aqueous-based polymer dispersion (sometimes referred to as a "latex" or "latex binder") and fire retardant salts are applied to the fabric (Block 6). The composition may be applied by spraying; padding; by mangle application; by dipping and nipping; or by any other means well known to those skilled in the art. The fire retardant may be any of the commercially available materials. It is preferred that the fire retardant composition include latex binder material. The binder helps in anchoring the fire retardant finish to the fabric. A preferred binder material is a dispersion of polyvinylidene chloride or ethylene vinyl chloride. It will be easily determined by those skilled in the art the level of fire retardant material and the level of binder material to be incorporated in the bath in order to obtain the desired fire retardant level and properties of hand, softness and tensile strength in the treated fabric.

Other materials such as soil repellents, water repellents, dyes, colorants and the like may be incorporated in the fire retardant composition.

It will be well known by those skilled in the art to adjust the wet add-on of the fire retardant composition depending, e.g., on the solids therein; the nature of the fabric; etc. to achieve the desired level of fire retardancy in the fabric.

The base fabric, now wet with the aqueous-based fire retardant composition, is next cross stretched (Block 7).

The cross stretching may be done using a typical textile pin tenter or clip tenter. The fabric may be cross stretched 40–100% or even more. It is preferred that the fabric be cross-stretched 60–80%. The recited percentage means that the fabric is caused to be that much wider after stretching than it was prior to stretching. For example a 10 inch wide fabric stretched 50% will be 15 inches wide after stretching. It will be well known to those skilled in the art to overfeed the fabric to the tenter so as to accommodate the cross-stretching of the fabric without causing a significant reduction in the base weight of the fabric.

The cross-stretched entangled nonwoven fabric, still wet by virtue of the application thereto of the aqueous-based fire retardant composition, is dried while maintaining the fabric under width wide tension (Block 8). This means the fabric is held in its stretched condition and not allowed to shrink back to a more narrow width. The drying is most easily accomplished in a conventional convection oven. The oven is operated at a temperature sufficient to dry the fabric at the processing speed without causing the fabric to char or discolor due to overheating. The dried fire retardant finished entangled nonwoven fabric of the invention is now batched or rolled up (Block 9).

Fabrics prepared in this manner are found to have balanced machine and cross-machine tensile strength properties. They also have fire retardant properties in both the machine direction and the cross machine direction of greater than 20 seconds when tested in accordance with National Fire Protection Association (NFPA) Test No. 702.

Tensile strength tests are performed on an Instron tester in accordance with standard procedure ASTM D5034. As heretofore stated, the fire retardancy is determined in accordance with NFPA Test No. 702 which is a procedure published by National Fire Protection Association of 60 Batterymarch St., Boston, Mass. 02110.

The following examples illustrate the practice of the invention:

EXAMPLE 1

A carded fibrous web of 100%, 1.5 denier, 1½" staple polyester fiber weighing 1.44 osy was prepared. The web was passed through a hydroentangling apparatus of the type disclosed in U.S. Pat. No. 3,485,706. In the apparatus, water jets were emitted from a series of rows of orifices having a diameter of about 0.005 inch. The web to be hydroentangled was supported on a 100×92 bronze wire twill weave belt (Appleton Wire Co. of Appleton, Wis.) as it passed under the water jets. Eleven (11) rows of orifices were employed. There were 50 orifices per inch in each of the rows. The web is subjected to 11 rows of orifices. The first row of orifices operate at 150 psig so as to wet the web and settle the fibers on the support belt. The next row of orifices operate at 550 psig. The third, fifth and sixth at 1,000 psig; the fourth at 350 psig; the seventh at 1,100 psig; the next three at 1,150 psig and the last at 1,200 psig. The web was processed at 100 yards per minute. The entangling energy was 0.7 hp-hr/lb. The entangled fabric was dried over conventional steam heated cans and rolled up.

An aqueous-based fire retardant composition was prepared having the following composition:

| Ingredient | Wt. % |
|---|---|
| Water | 88.26 |
| Air Flex 4500 | 3.28 |
| Flameproof 736 | 3.06 |
| Milease F-31X | 3.01 |
| Graphtol Blue 6825-2 | 0.28 |
| Graphtol Green 5869-2 | 2.07 |
| Hodag Antifoam NC24 | 0.04 |

Airflex 4500 is an aqueous dispersion of an ethylene-vinyl chloride copolymer latex supplied by Air Products and Chemicals Inc. of Allentown, Pa. Flameproof 736 consists of phosphate flame retardant salts and was supplied by Apex Chemical Corp. of Elizabeth, N.J. Milease F-31X is a fluorochemical repellent supplied by ICI Americas Inc. of Wilmington, Del. Graphtol Blue and Graphtol Green are pigments supplied by Sandoz Chemicals of Charlotte, N.C. and Hodag Antifoam is a silicone emulsion antifoam supplied by Hodag Corp. of Skokie, Ill.

The ingredients were stirred until uniform. The resulting fire retardant treatment composition had 4.5% solids.

The treatment composition was placed in a standard padder using unengraved rolls. The fabric was passed through the padder with sufficient residence time and padder pressure so that the fabric had a 140%, i.e. 1.4 times the dry fabric weight, wet pickup.

The wetted fabric which was 96 inches wide was placed on a pin tenter for cross-stretching and drying. The pin tenter had 6 zones operated as follows:

| Zone | Frame Width Inches) | Oven Temp °F. |
|---|---|---|
| 1 | 140 | 370 |
| 2 | 164 | 370 |
| 3 | 164 | 380 |
| 4 | 164 | 390 |
| 5 | 164 | 410 |
| 6 | 164 | 410 |

The frame speed was 64 ypm and the fabric feed rate was 80 ypm (i.e., the wet fabric was overfed to the tenter). The treated and dried fabric was rolled up.

EXAMPLE 2

The procedure of Example i was followed except the initial carded web weighed 1 osy and the fire r etardant treated fabric was not cross-stretched in the tenter frame. The frame was set at 96 inches in all six zones.

EXAMPLE 3

The procedure of Example 1 was followed except the initial carded web weighed 1 osy, the fabric was entangled wih an input energy of 1 hp-hr/lb. and the tenter was set to cause a 15% cross-stretch.

EXAMPLE 4

The procedure of Example 1 was followed and the tenter was set to cause a 70% cross-stretch. The base fabric was entangled with an input energy of 0.7 hp-hr/lb.

EXAMPLE 5

The procedure of Example 1 was followed with the tenter set to provide a 123% cross-stretch. The base fabric was entangle with an input energy of 0.7 hp-hr/lb.

A summary of the process conditions and the results of testing the fabrics of the examples is set forth in Table I.

TABLE I

| Example No. | 1 | 2 | 3 | 4 | 5 |
|---|---|---|---|---|---|
| Fabric Wt. (osy) | 1.05 | 1.05 | 0.9 | 1.1 | 1.3 |
| Entangling Energy (hp-hr/lb.) | 1 | 1 | 1 | 0.7 | 0.7 |
| Cross-Stretch % | 71 | 0 | 15 | 70 | 123 |
| Overfeed % | 25 | 0 | 17 | 25 | 67 |
| Frame Speed ypm | 64 | — | 60 | 60 | 60 |
| Tensile Strength, lbs. | | | | | |
| Machine Direction | 19 | 23 | 23 | 22 | 16 |
| Cross Direction | 15 | 11 | 11 | 22 | 21 |
| Flammability, sec. | | | | | |
| Machine Direction | >20 | 4 | 14 | >20 | >20 |
| Cross Direction | >20 | >20 | >20 | >20 | 19 |

As can be seen from the data in Table I, the fabrics of Examples 1 and 4 have fire retardancies of greater than 20 seconds in both the machine direction and the cross machine direction. In addition, as can be seen by referring to the tensile strength data, these fabrics have balanced tensile strength properties. As can also be seen from the data in Table I, the fabrics of Examples 2 and 3 have good fire retardancy in the cross machine direction, but have poor fire retardant properties in the machine direction. This is evidently the result of the fact that the machine direction tensile strength of these fabrics is over twice the cross machine direction strength, i.e., these two fabrics do not have balanced tensile strength properties. Still referring to the data in Table I, the fabric of Example 5 has a fire retardancy in the machine direction of greater than 20 seconds, but has a fire retardancy in the cross machine direction of less than 20 seconds. In this instance, it is believed that the reduced fire retardancy in the cross machine direction is associated with the fact that the fabric does not have balanced tensile strength properties due to over stretching prior to drying.

What is claimed is:

1. A fire retardant hydroentangled nonwoven fabric comprising polyester fibers wherein said fabric has balanced machine direction and cross machine direction tensile strength properties and essentially balanced machine direction and cross machine direction fire retardant properties.

2. A fire retardant hydroentangled nonwoven fabric comprising polyester fibers wherein said fabric has balanced machine direction and cross machine direction tensile strength properties and wherein said fabric has a fire retardancy as measured by NFPA Test No. 702 of greater than 20 seconds in both its machine direction and its cross machine direction.

3. The fabric of claim 2 wherein said fabric has a basis weight of 0.3 osy to 4 osy.

4. A method of producing a fire retardant hydroentangled nonwoven fabric comprising polyester fibers, which fabric has balanced machine direction and cross machine direction tensile strength properties and a fire retardant property of greater than 20 seconds in both its machine direction and cross machine direction, said method comprising:

A. forming a web of polyester fibers;

B. hydroentangling said web of polyester fibers;

C. drying said web of hydroentangled fibers;

D. wetting said web of hydroentangled fibers with an aqueous-based fire retardant composition;

E. cross-stretching said wetted web; and

F. drying said wetted web while maintaining said web in its stretched condition.

5. The method of claim 4 wherein said fabric has a basis weight of 0.3 osy to 4 osy.

6. The method of claim 4 wherein said hydroentangling of said web of polyester fibers is accomplished with an energy input of at least 0.5 hp-hr/lb.

7. The method of claim 4 wherein said hydroentangling of said web of polyester fibers is accomplished with an energy input of at least 0.7 hp-hr/lb.

8. The method of claim 4 wherein said wetted web is cross-stretched between 40% and 100%.

9. The method of claim 4 wherein said wetted web is cross-stretched between 60% and 80%.

* * * * *